US009459554B1

(12) United States Patent
Niijima

(10) Patent No.: US 9,459,554 B1
(45) Date of Patent: Oct. 4, 2016

(54) IMAGE FORMATION APPARATUS

(71) Applicant: Oki Data Corporation, Tokyo (JP)

(72) Inventor: Yoshio Niijima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/046,502

(22) Filed: Feb. 18, 2016

(30) Foreign Application Priority Data

Mar. 19, 2015 (JP) ..... 2015-056125

(51) Int. Cl.
*G03G 15/08* (2006.01)

(52) U.S. Cl.
CPC ..... *G03G 15/0831* (2013.01)

(58) Field of Classification Search
USPC ..... 399/9, 24, 25, 27–30, 38, 46, 53–55
See application file for complete search history.

(56) References Cited

U.S. PATENT DOCUMENTS 8,107,840 B2 * 1/2012 Niijima ..... G03G 15/065 399/55

FOREIGN PATENT DOCUMENTS

JP H09-054488 A 2/1997

* cited by examiner

*Primary Examiner* — Hoan Tran
(74) *Attorney, Agent, or Firm* — Mots Law, PLLC

(57) ABSTRACT

An image formation apparatus includes: an image carrier; an exposure unit; a developer container part; a developer supply unit; a development unit; a remaining amount detector which detects a remaining amount of the developer in the container part; a development voltage application unit which applies a development voltage to the development unit; a supply voltage application unit which applies a supply voltage to the supply unit; and a voltage controller which controls the development voltage and the supply voltage. When the remaining amount of the developer detected by the remaining amount detector is reduced to a predetermined first threshold or less, the voltage controller makes an absolute value of a difference between the development voltage and the supply voltage smaller than that used when the remaining amount of the developer is larger than the first threshold.

8 Claims, 7 Drawing Sheets

Fig. 9A

TA: DEVELOPMENT-SUPPLY BIAS DIFFERENCE BASIC AMOUNT TABLE

| CORRECTION BASIC AMOUNT RA | | REMAINING AMOUNT OF TONER (g) | | | | | |
|---|---|---|---|---|---|---|---|
| | | 80≧ | 60≧ | 40≧ | 30≧ | 20≧ | 10≧ |
| AVERAGE IMAGE RATIO | 1%≧ | 4 | 6 | 10 | 14 | 24 | 30 |
| | 2%≧ | 2 | 3 | 5 | 7 | 12 | 15 |
| | 3%≧ | 2 | 2 | 3 | 5 | 8 | 10 |
| | 5%≧ | 1 | 2 | 2 | 3 | 5 | 6 |
| | 10%≧ | 1 | 1 | 2 | 2 | 3 | 3 |

Fig. 9B

TB: CORRECTION COEFFICIENT TABLE

| CORRECTION COEFFICIENT RB | DRUM ROTATIONS OVER 30 MIN | | | | |
|---|---|---|---|---|---|
| | 100≦ | 200≦ | 300≦ | 400≦ | 500≦ |
| | 1 | 1.1 | 1.2 | 1.3 | 1.4 |

Fig. 10A

TC: DEVELOPMENT BIAS CORRECTION BASIC AMOUNT TABLE

| CORRECTION BASIC AMOUNT RC | | REMAINING AMOUNT OF TONER (g) | | | | | |
|---|---|---|---|---|---|---|---|
| | | 80≧ | 60≧ | 40≧ | 30≧ | 20≧ | 10≧ |
| AVERAGE IMAGE RATIO | 1%≧ | 0 | 0 | 3 | 6 | 8 | 10 |
| | 2%≧ | 0 | 0 | 2 | 5 | 6 | 8 |
| | 3%≧ | 0 | 0 | 2 | 4 | 5 | 6 |
| | 5%≧ | 0 | 0 | 1 | 3 | 4 | 5 |
| | 10%≧ | 0 | 0 | 1 | 2 | 3 | 4 |

Fig. 10B

TD: CORRECTION COEFFICIENT TABLE

| CORRECTION COEFFICIENT RD | DRUM ROTATIONS OVER 30 MIN | | | | |
|---|---|---|---|---|---|
| | 100≦ | 200≦ | 300≦ | 400≦ | 500≦ |
| | 1 | 1.1 | 1.2 | 1.3 | 1.4 |

IMAGE FORMATION APPARATUS

CROSS REFERENCE TO RELATED APPLICATIONS

This application claims priority based on 35 USC 119 from prior Japanese Patent Application No. 2015-056125 filed on Mar. 19, 2015, entitled "IMAGE FORMATION APPARATUS", the entire contents of which are incorporated herein by reference.

BACKGROUND OF THE INVENTION

1. Field of the Invention

This disclosure relates to an image formation apparatus and one suitably employed for an electrophotographic printer, for example.

2. Description of Related Art

A conventional image formation apparatus uniformly charges the surface of a photoreceptor drum as an image carrier and exposes the surface with an exposure device to form an electrostatic latent image. The image formation apparatus then charges toner as the developer and causes the charged toner to adhere to the electrostatic latent image to form a toner image. Subsequently, the image formation apparatus transfers the toner image formed on the surface of the photoreceptor drum onto paper as a medium and fixes the toner image, thus printing an image.

In many image formation apparatuses, toner is stored in a replaceable toner cartridge. In connection with this, there is an image formation apparatus proposed which detects the amount of toner remaining in the toner cartridge and prompts the user to replace the toner cartridge when the amount of toner remaining becomes small (see Patent Literature 1, for example).

Patent Literature 1: Japanese Patent Laid-open Publication No. 9-54488 (FIG. 1)

SUMMARY OF THE INVENTION

Such an image formation apparatus as described above sometimes forms an image having a comparatively low ratio of an area to which toner actually adheres on the surface of the photoreceptor drum to the entire area thereof available for formation of the toner image. Such an image is hereinafter referred to as a low-duty image. When a low-duty image is continuously printed, toner which does not adhere to the surface of the photoreceptor drum is excessively charged in the toner cartridge.

Moreover, in the image formation apparatus, when low-duty images are continuously formed with a comparatively small amount of toner remaining in the toner cartridge, the same toner particles are repeatedly charged in the toner cartridge, thus significantly increasing the amount of charge of toner in some cases. Such toner could unnecessarily adhere to part of the surface of the photoreceptor drum other than the electrostatic latent image, that is, the part to which the toner must not adhere.

The conventional image formation apparatuses therefore have a problem that when the image formation apparatuses continuously form low-duty images with a comparatively small amount of toner remaining in the toner cartridge, extra toner could adhere to the part, other than that of the electrostatic latent image, of the surface of the photoreceptor drum and eventually be transferred to a media, resulting in "contamination".

An object of an embodiment of the invention is to prevent adhesion of extra developer to the media.

An aspect of the invention is an image formation apparatus that includes: an image carrier; an exposure unit which exposes the image carrier to form a latent image; a container part which stores a developer; a supply unit which supplies the developer within the container part; a development unit which supplies the developer supplied from the supply unit to the latent image on the image carrier for development; a remaining amount detector which detects a remaining amount of the developer in the container part; a development voltage application unit which applies development voltage to the development unit; a supply voltage application unit which applies a supply voltage to the supply unit; and a voltage controller which controls the development voltage and the supply voltage. When the remaining amount of the developer which is detected by the remaining amount detector is reduced to a predetermined first threshold or less, the voltage controller makes an absolute value of a difference between the development voltage and the supply voltage smaller than that used when the remaining amount of the developer is larger than the first threshold.

In the invention, when the remaining amount of the developer in the housing becomes small, it is possible to prevent adhesion of extra developer to the image carrier by making an absolute value of the difference between the development voltage and the supply voltage. As a result, it is possible to prevent the occurrence of contamination due to transfer of the extra developer to the media.

According to this aspect of the invention, it is possible to prevent the adhesion of extra developer to the media.

BRIEF DESCRIPTION OF THE DRAWINGS

FIG. 9A illustrates a development-supply bias difference correction basic amount table, and FIG. 9B illustrates a correction coefficient table.

FIG. 10A illustrates a development bias correction basic amount table, and FIG. 10B illustrates a correction coefficient table.

DETAILED DESCRIPTION OF EMBODIMENTS

Figure 1:
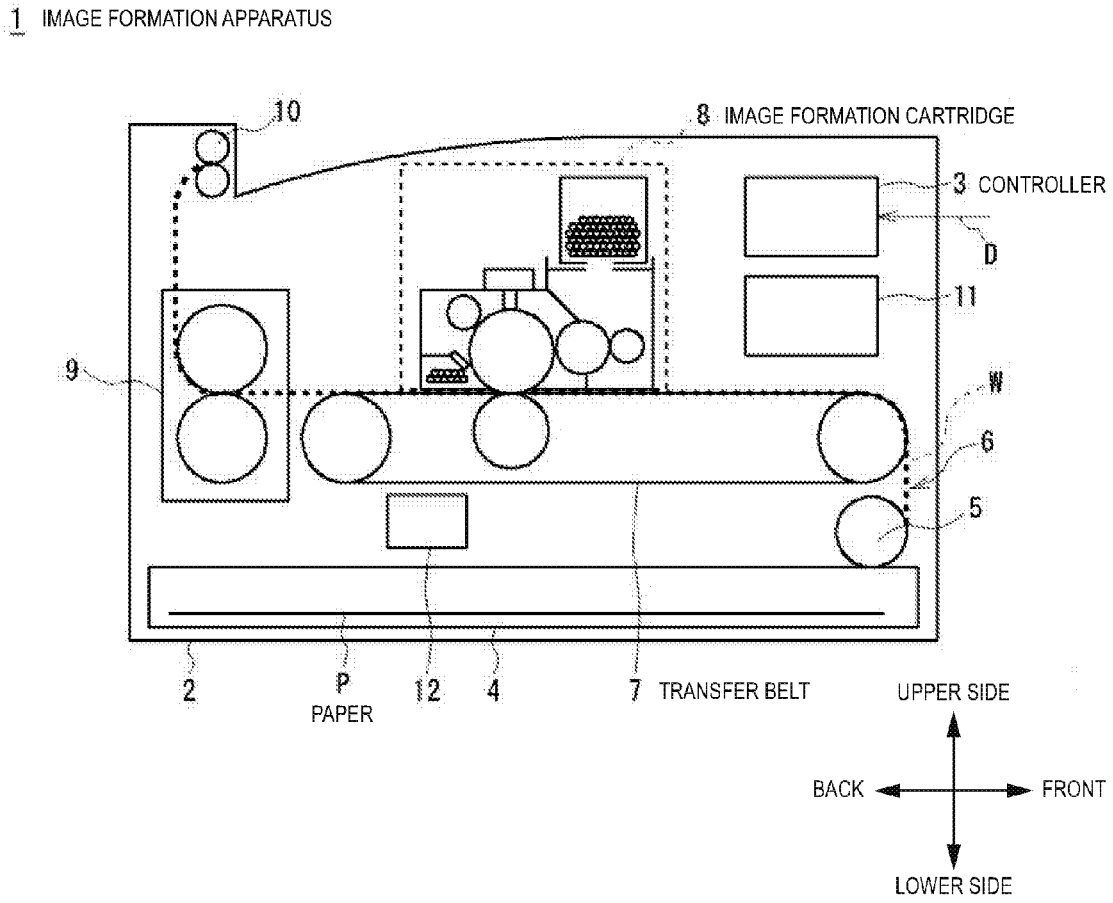
FIG. 1 is a schematic diagram illustrating the configuration of an image formation apparatus.

Descriptions are provided hereinbelow for embodiments based on the drawings. In the respective drawings referenced herein, the same constituents are designated by the same reference numerals and duplicate explanation concerning the same constituents is omitted. All of the drawings are provided to illustrate the respective examples only.

1. Configuration of the Image Formation Apparatus

[1-1. Entire Configuration of the Image Formation Apparatus]

As illustrated in FIG. 1, image formation apparatus 1 is constructed as an electrophotographic printer and is configured to form an image on paper P as the medium through various mechanisms provided within cuboid casing 2. Image formation apparatus 1 is integrally controlled by controller 3 (described in detail later).

Controller 3 is connected to a master device (not illustrated), such as a personal computer, wirelessly or by wire. When receiving image data D representing an image to be printed and an instruction to print the image from the master device, controller 3 executes a printing process to form a print image on the surface of paper P.

In the following description, the side of image formation apparatus 1 facing the user is referred to as the front side (the right side in FIG. 1) while the other side is referred to as the back side (the left side in FIG. 1). Left and right refer to relative positions seen from the user facing the front side of image formation apparatus 1. The upper and lower sides are similarly defined in the description.

Near the bottom of image formation apparatus 1, paper cassette 4 for storing sheets of paper P is provided. Near the upper front end of paper cassette 4, pick-up roller 5 which separates and feeds sheets of paper P one by one is provided. Within casing 2, conveyance section 6 which conveys sheets of paper P fed by pick-up roller 5 is provided. Conveyance section 6 includes an assembly of a roller, a belt, a driving power source such as a motor, and a guide, which are not illustrated, and forms a conveyance path W as indicated by a dashed line in FIG. 1. Conveyance path W connects the lower front side and the upper back side in casing 2 to form a shape similar to the letter "S" as seen from the left side.

In the middle of casing 2 in the vertical direction, transfer belt 7 constituting a part of conveyance section 6 is provided. Transfer belt 7 includes an endless belt and is laid across rollers provided on the front and back sides. The upper surface of transfer belt 7 extends along conveyance path W. Transfer belt 7 runs along with the rotation of the rollers so that the upper surface moves backward, thus conveying paper P along conveyance path W.

Above transfer belt 7, image formation cartridge 8 is provided. Image formation cartridge 8 generates a toner image based on the image data acquired from the master device, and transfers the toner image onto paper P conveyed along conveyance path W. Image formation cartridge 8 is detachable from casing 2.

Fixing unit 9 is behind image formation cartridge 8, that is, is on the downstream side of conveyance path W. Fixing unit 9 applies heat and pressure to paper P with the toner image transferred thereto to fix the toner image to paper P. Paper P with the toner image fixed thereon, that is, paper P on which the image based on image data D is printed, is conveyed upward by conveyance section 6 and is ejected by delivery rollers 10 to the outside of casing 2. To be specific, the printed paper P is ejected onto a paper output tray formed in the upper surface of casing 2.

[1-2. Configuration of the Image Formation Cartridge]

Figure 2:
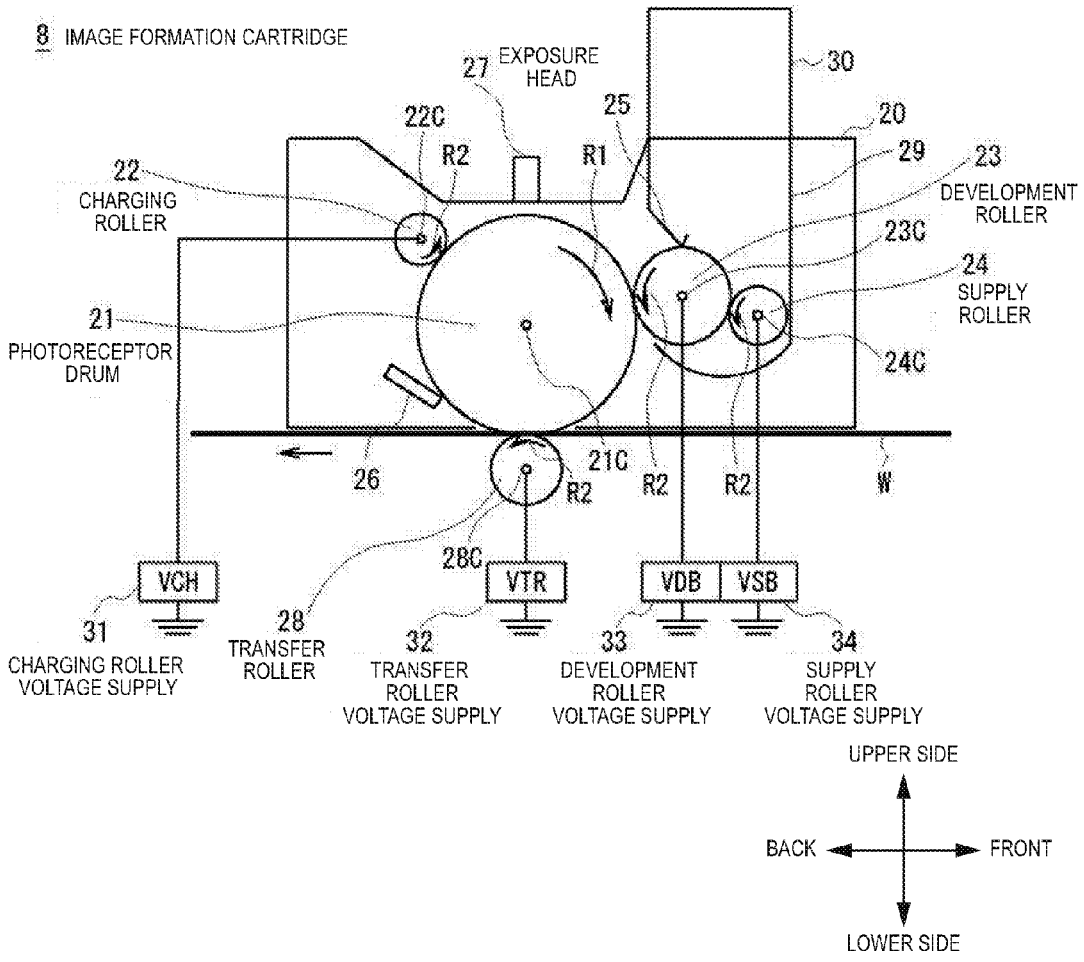
FIG. 2 is a schematic diagram illustrating the configuration of an image formation cartridge.

As illustrated in FIG. 2, image formation cartridge 8 includes photoreceptor drum 21, charging roller 22, development roller 23, supply roller 24, toner control member 25, and cleaner 26, which are provided within cartridge casing 20 having a hollow box shape.

Photoreceptor drum 21 as an image carrier has a cylindrical shape around a central shaft 21C extending in the cross direction. Photoreceptor drum 21 rotates in the direction of arrow R1 with a driving force supplied from a not-illustrated driving force source. Photoreceptor drum 21 is configured as an organic photoreceptor and includes: a cylindrical member made of a metallic material, such as aluminum, for example; and charge generating and transporting layers which are sequentially stacked on the circumferential surface of the cylindrical member.

Charging roller 22 is cylindrical around the central axis extending in the cross direction and is narrower than photoreceptor drum 21. Charging roller 22 rotates in the direction of arrow R2 by a driving force supplied from a not-illustrated driving force source. Charging roller 22 includes: central shaft 22C which is metallic and extends along the central axis; and a layer of semiconducting rubber around central shaft 22C. Charging roller 22 is located behind and above photoreceptor drum 21 and the circumferential surface of charging roller 22 abuts on the circumferential surface of photoreceptor drum 21. Charging roller 22 is supplied with a charging voltage VCH generated by charging roller voltage supply 31.

Development roller 23 as a development unit is cylindrical around the central axis extending along the cross direction and is narrower than photoreceptor drum 21. Development roller 23 rotates in the direction of arrow R2 by a driving force supplied from a not-illustrated driving force source. Development roller 23 includes: central shaft 23C which is metallic and extends along the central axis; and a layer of semiconducting rubber around central shaft 23C in a similar manner to charging roller 22. Development roller 23 is located to the front of photoreceptor drum 21, and the circumferential surface of development roller 23 abuts on the circumferential surface of photoreceptor drum 21. Development roller 23 is supplied with development bias VDB, which is generated by development roller voltage supply 33 as a development voltage application unit.

Supply roller 24 as a supply unit is cylindrical around the central axis extending in the cross direction and is narrower than development roller 23. Supply roller 24 rotates in the direction of arrow R2 by a driving force supplied from a not-illustrated driving force source. Supply roller 24 includes: central shaft 24C which is metallic and extends along the central axis; and a layer of a foamed urethane rubber material or the like around central shaft 24C. Supply roller 24 is located to the front of development roller 23, and the circumferential surface of supply roller 24 abuts on the circumferential surface of development roller 23. Supply roller 24 is supplied with supply bias VSB, which is generated by supply roller voltage supply 34 as a supply voltage application unit.

Toner control member 25 has a thin plate shape elongated in the cross direction. The thickness of toner control member 25 is about 0.1 mm, for example. Toner control member 25 is located above development roller 23. An end of toner control member 25 in the short direction is fixed to cartridge casing 20. Toner control member 25 is bent at a position slightly apart from the other end to form a bent surface. The bent surface is pressed against development roller 23 by the elastic force of the toner control member 25. Cleaner 26 has a plate shape elongated in the cross direction and is located below and behind photoreceptor drum 21. The upper edge of cleaner 26 is in contact with the circumferential surface of photoreceptor drum 21.

Exposure head 27 as an exposure unit is attached to casing 2 (FIG. 1) of image formation apparatus 1. Exposure head 27 is located just above photoreceptor drum 21 and outside of cartridge casing 20. Exposure head 27 includes a light source, such as a light emitting diode (LED) or a laser, and based on the image data, projects light from the light source along a main scanning direction (in the cross direction) on a dot-by-dot (pixel-by-pixel) basis.

Transfer roller 28 is cylindrical around the central axis extending in the cross direction and is narrower enough than photoreceptor drum 21. Transfer roller 28 rotates in the direction of arrow R2 by a driving force supplied from a not-illustrated driving force source. Transfer roller 28 includes: central shaft 28C which is metallic and extends along the central axis; and a layer of a foamed urethane rubber material or the like and is provided around central shaft 28C. Transfer roller 28 is located just under photoreceptor drum 21 across transfer belt 7 running along conveyance path W. The circumferential surface of transfer roller 28 is pressed against the circumferential surface of photoreceptor drum 21 with transfer belt 7 interposed therebetween. Transfer roller 28 is supplied with a transfer voltage VTR, which is generated by transfer roller voltage supply 32.

In the front of photoreceptor drum 21 in the cartridge casing 20, that is, in the vicinity of development roller 23 and supply roller 24, toner storing unit 29 is formed as a container part storing toner. Within toner storing unit 29, a toner end sensor (not illustrated) is provided. The toner end sensor is configured to detect that the remaining amount of toner is extremely small. When the remaining amount of toner is extremely small, the toner end sensor notifies controller 3 (FIG. 1) that the remaining amount of toner is extremely small.

Above toner storing unit 29, toner cartridge 30 to supply toner is provided. Toner cartridge 30 is detachable from cartridge casing 20. Toner cartridge 30 is provided with a not-illustrated toner cartridge tag. The toner cartridge tag indicates an individual identification number so that the number can be identified individually. In casing 2 of image formation apparatus 1, a tag reader (not illustrated) to read the toner cartridge tag is provided. The tag reader reads the toner cartridge tag and notifies controller 3 of the read data.

[1-3. Block Configuration of the Image Formation Apparatus]

Figure 3:
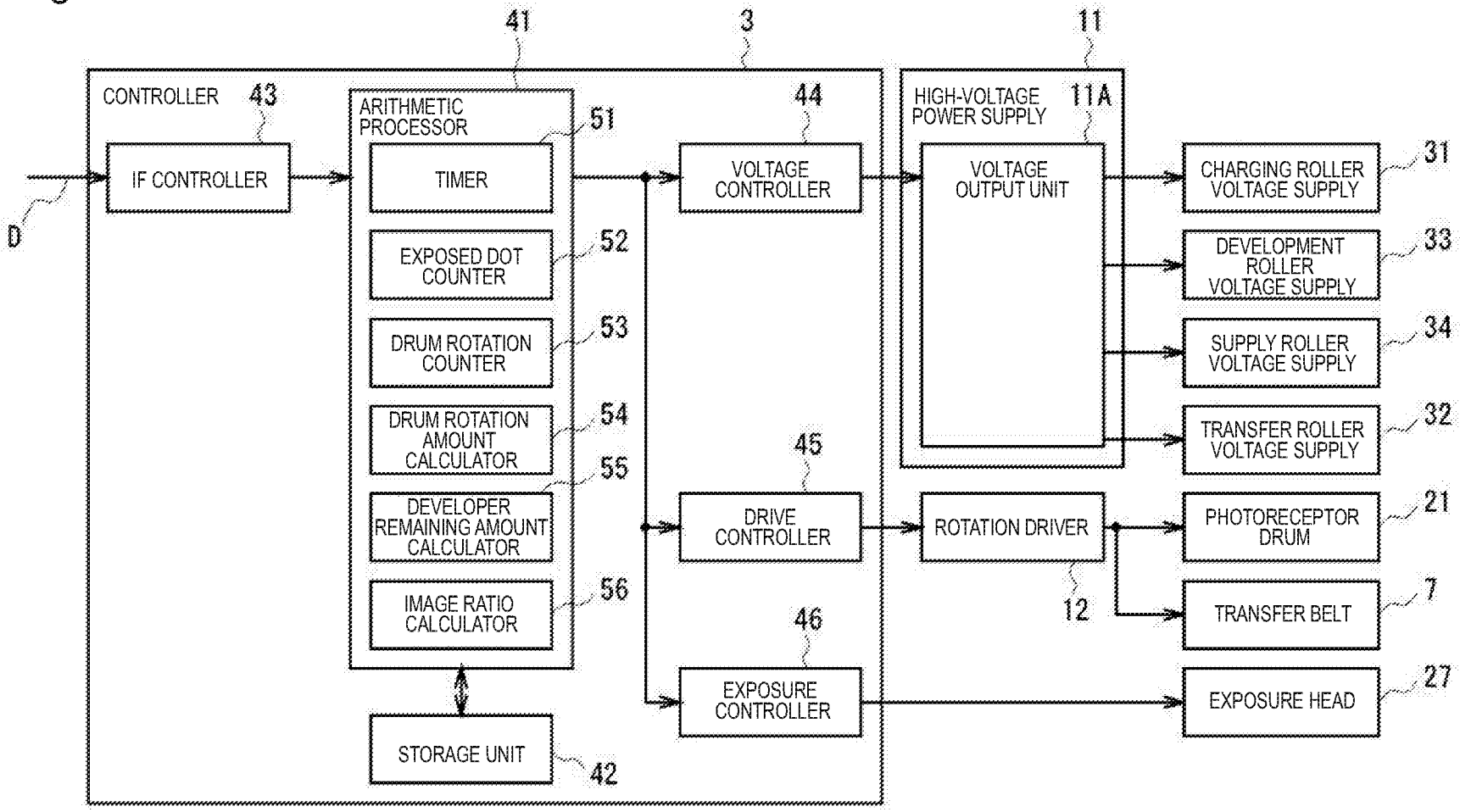
FIG. 3 is a block diagram illustrating a block configuration of the image formation apparatus.

Next, a description is given of the block configuration of image formation apparatus 1 with reference to FIG. 3. Image formation apparatus 1 is integrally controlled by controller 3. Controller 3 mainly includes arithmetic processor 41. Arithmetic processor 41 is configured as a so-called central processing unit (CPU) and executes various arithmetic processes.

Storage unit 42 is connected to arithmetic processor 41 and includes a read only memory (ROM) and a RAM (random access memory) and moreover a flash memory, a hard disk drive, or the like. Storage unit 42 stores a sequence program for the printing operation, various data to control image formation apparatus 1, various settings, and the like. Storage unit 42 is used as a work area of each program or a temporary storage area for various data.

IF (interface) controller 43 is connected wirelessly or by wire to a master device (not illustrated) such as a personal computer. IF controller 43 acquires image data D, an instruction to print image data D, and the like from the master device and supplies the same to arithmetic processor 41. Arithmetic processor 41 performs a predetermined processing for image data D and supplies the same to exposure controller 46 while controlling voltage controller 44 and drive controller 45.

Voltage controller 44 sets values of voltage outputted from voltage output unit 11A of high-pressure power supply 11 based on the control by arithmetic processor 41 and controls an on and off of the output. Voltage output unit 11A then outputs voltages of the values individually set to charging roller voltage supply 31, development roller voltage supply 33, supply roller voltage supply 34, and transfer roller voltage supply 32.

Drive controller 45 controls the on and off of the driving power from rotation driver 12 based on the control by arithmetic processor 41. Rotation driver 12 includes a driving force source such as a direct current (DC) motor or a pulse motor, gears for transmitting the driving force, and the like, for example. Rotation driver 12 individually supplies a driving power to photoreceptor drum 21, transfer belt 7, and various rollers constituting conveyance section 6 based on the control by drive controller 45. Exposure controller 46 supplies data supplied from arithmetic processor 41 to exposure head 27.

Arithmetic processor 41 reads an image formation program from storage unit 42 for execution and constitutes plural functional blocks including timer 51, exposure dot counter 52, drum rotation counter 53, drum rotation amount calculator 54, remaining developer calculator 55, and image ratio calculator 56.

Timer 51 measures time. Exposure dot counter 52 counts the number of dots (pixels) at which exposure head 27 emits light based on the control by exposure controller 46. Drum rotation counter 53 counts the number of rotations of photoreceptor drum 21. Drum rotation amount calculator 54 calculates the number of rotations of photoreceptor drum 21 per predetermined period of time based on the number of rotations obtained by drum rotation counter 53. Remaining developer calculator 55 as a remaining amount detector calculates the amount of toner remaining in toner storing unit 29 (FIG. 2).

Image ratio calculator 56 calculates the image ratio per predetermined area. Herein, the image ratio refers to the ratio of the number of dots (pixels) filled (dots at which toner is attached to paper P) to the number of all the dots (pixels) within a printable area. For example, if the entire printable area is filled, as in a solid image, the image ratio is 100%.

2. Image Forming Operation

Next, a description is given of a basic image forming operation in image formation apparatus 1. Controller 3 controls the voltage output unit 11A of high-voltage power supply 11 through voltage controller 44 (FIG. 3) so as to cause charging roller voltage supply 31 to generate charge voltage VCH (−600 V, for example) and supply the same to charging roller 22 of image formation cartridge 8 (FIG. 2). Charging roller 22 abuts on photoreceptor drum 21 and uniformly charges the surface of photoreceptor drum 21 to a predetermined electric potential with a predetermined polarity.

Controller 3 performs a predetermined process for image data D supplied from the master device in arithmetic processor 41 and then supplies the same to exposure controller 46, and then supplies the image data D to exposure head 27 (FIG. 2). Accordingly, an electrostatic latent image in accordance with an image pattern based on image data D is formed on the surface of photoreceptor drum 21.

On the other hand, in image formation cartridge 8 (FIG. 2), supply bias VSB (−300 V, for example) supplied from supply roller voltage supply 34 is applied to supply roller 24, and development bias VDB (−200 V, for example) supplied from development roller voltage supply 33 is applied to development roller 23. Toner storing unit 29 stores toner that tends to be charged negatively.

When supply roller 24 rotates in the direction of arrow R2 with a difference in electric potential formed between supply bias VSB and development bias VDB, toner in toner storing unit 29 adheres to the surface of development roller 23. In this process, the surface of supply roller 24 moves in the opposite direction to that of the surface of development roller 23 at the point of contact between supply roller 24 and development roller 23. Supply roller 24 therefore can remove extra toner from the surface of development roller 23.

When development roller 23, to the surface of which toner is caused to adhere by supply roller 24, rotates in the direction of arrow R2, extra toner is removed by toner control member 25, so that a uniform thin-film layer of toner is formed on the circumferential surface of development roller 23. The thickness of the toner layer is determined by a pressing force of toner control member 25 against development roller 23 or the like. When development and supply rollers 23 and 24 and photoreceptor drum 21 are rotationally driven, the toner adhering to the surface of development roller 23 is triboelectrically charged at the place where development roller 23 is in contact with toner control member 25 abutting on the same and at the place where supply roller 24 is in contact with photoreceptor drum 21.

Photoreceptor drum 21 rotates in the direction of arrow R1, and the portion of photoreceptor drum 21 where the electrostatic latent image has been formed in the upper side proceeds to the point of contact with development roller 23, which is located to the front. Development roller 23 rotates in the direction of arrow R2 to bring toner adhering to the surface of development roller 23 into contact with the surface of photoreceptor drum 21. In this process, toner moves and adheres to the surface of photoreceptor drum 21 due to the difference in electric potential in the portion of the surface of photoreceptor drum 21 where the electrostatic latent image is formed. On the surface of photoreceptor drum 21, a toner image based on image data D is thus formed.

Photoreceptor drum 21 rotates in the direction of arrow R1, and the portion where the toner image is formed proceeds to the point of contact with the transfer belt 7 under photoreceptor drum 21. In this process, transfer voltage VTR supplied from transfer roller voltage supply 32 is applied to transfer roller 28 located under transfer belt 7. On transfer belt 7, paper P conveyed by conveyance section 6 is placed. In other words, paper P and transfer belt 7 are sandwiched between photoreceptor drum 21 and transfer roller 28. In this process, toner constituting the toner image formed on photoreceptor drum 21 is transferred onto paper P due to the difference in electric potential between photoreceptor drum 21 and transfer roller 28 without changing the toner image.

Paper P is then conveyed to fixing unit 9 along conveyance path W by conveyance section 6 (FIG. 1), and the toner image is fixed on paper P. In such a manner, the image based on image data D is formed on paper P, that is, is printed. Hereinafter, the above-described series of operations in image formation apparatus 1 is referred to as an image forming operation or printing operation.

The toner remaining on the surface of photoreceptor drum 21 after the transfer onto paper P is removed from the surface of photoreceptor drum 21 by cleaner 26. If paper P is not sandwiched between transfer belt 7 and photoreceptor drum 21 because of a conveyance failure of paper P or the like, toner adhering to the surface of photoreceptor drum 21 is transferred onto transfer belt 7. The toner transferred to transfer belt 7 reaches a not-illustrated toner scraper along the travel of transfer belt 7 and is removed from transfer belt 7 by the toner scraper.

As described above, image formation apparatus 1 forms a toner image based on image data D on the surface of photoreceptor drum 21 within image formation cartridge 8 by using the differences in electric potential between the voltages applied to the individual units, including development roller 23 and supply roller 24, and then transfers the same onto paper P.

3. Correction of Applied Voltage in Accordance with the Remaining Amount of Toner

[3-1. Relationship Between the Amount of Toner Remaining in Image Formation Cartridge and the Contamination or Print Density]

When the amount of toner remaining in toner storing unit 29 of image formation cartridge 8 (FIG. 2) is comparatively small, image formation apparatus 1 sometimes causes a phenomenon different from that in the case where the remaining amount of toner is comparatively large. Hereinafter, the amount of toner remaining in toner storing unit 29 of image formation cartridge 8 is referred to as a remaining amount of toner. For example, as for image formation cartridge 8, when the process to continuously print image data of a low image ratio described above (hereinafter, referred to as a low-duty continuous printing) is performed with a comparatively small remaining amount of toner, unnecessary toner is sometimes transferred to paper P, and contaminates paper P.

Specifically, in image formation cartridge 8, as described above, the surface of photoreceptor drum 21 is uniformly charged negatively (to −600 V, for example) by charging roller 22. In photoreceptor drum 21, when a part where an electrostatic latent image is intended to be formed is irradiated with light (or is exposed to light) by exposure head 27, the surface electric potential of the exposed part in the surface lowers (to −50 V, for example).

On the other hand, toner storing unit 29 stores toner that tends to be charged negatively. A development bias VDB (−200 V, for example) is applied to development roller 23 from development roller voltage supply 33. At the point of contact between development roller 23 and photoreceptor drum 21, the toner adhering to the surface of development roller 23, which is charged negatively, moves to apart of a large positive electric potential, that is, the part where the electrostatic latent image is formed in the surface of photoreceptor drum 21 by the coulomb force.

In this process, the toner adhering to development roller 23 in image formation cartridge 8 is more likely to move to the surface of photoreceptor drum 21 when the toner has a higher amount of negative charge. The toner adhering to development roller 23 therefore sometimes adheres to other than the electrostatic latent image on the surface of photoreceptor drum 21 as extra toner when the toner has an excessive amount of negative charge. In image formation apparatus 1, such extra toner is transferred onto paper P eventually, resulting in the contamination described above.

In image formation cartridge 8, toner adhering to development roller 23 is triboelectrically charged mainly at the point of contact between development roller 23 and supply roller 24 and at the point of contact between toner controller 25 and photoreceptor drum 21. Accordingly, in image formation cartridge 8, the likelihood that the same toner particles go around development roller 23 and supply roller 24 is higher when the remaining amount of toner is comparatively small than when the remaining amount of toner is comparatively large.

Moreover, in image formation cartridge 8, when the remaining amount of toner is comparatively small and a low-duty continuous printing is performed, the likelihood that the same toner particles go around development roller 23 and supply roller 24 is further increased compared to the case when the remaining amount of toner is large. Accordingly, the toner adhering to development roller 23 tends to have a high amount of charge in image formation cartridge 8, increasing the likelihood of contamination.

Furthermore, when image formation apparatus 1 performs a low-duty continuous printing, the same toner particles could be repeatedly subjected to frictional heat from development roller 23, supply roller 24, and toner control member 25 in image formation cartridge 8 because of the aforementioned reason.

The toner subjected to frictional heat tends to flocculate. In addition, the performance of supply roller 24 scraping toner from development roller 23 deteriorates due to the frictional heat in image formation cartridge 8, which sometimes increases the amount of toner adhering to the surface of development roller 23. In such a case, in image formation apparatus 1, the amount of toner adhering to photoreceptor drum 21 is larger than the amount that it should be, and the image printed on paper P tends to eventually have an excessively high density.

[3-2. Relationship Between the Development-Supply Bias Difference and the Amount of Charge of Toner with Respect to the Remaining Amount of Toner]

Figure 4:
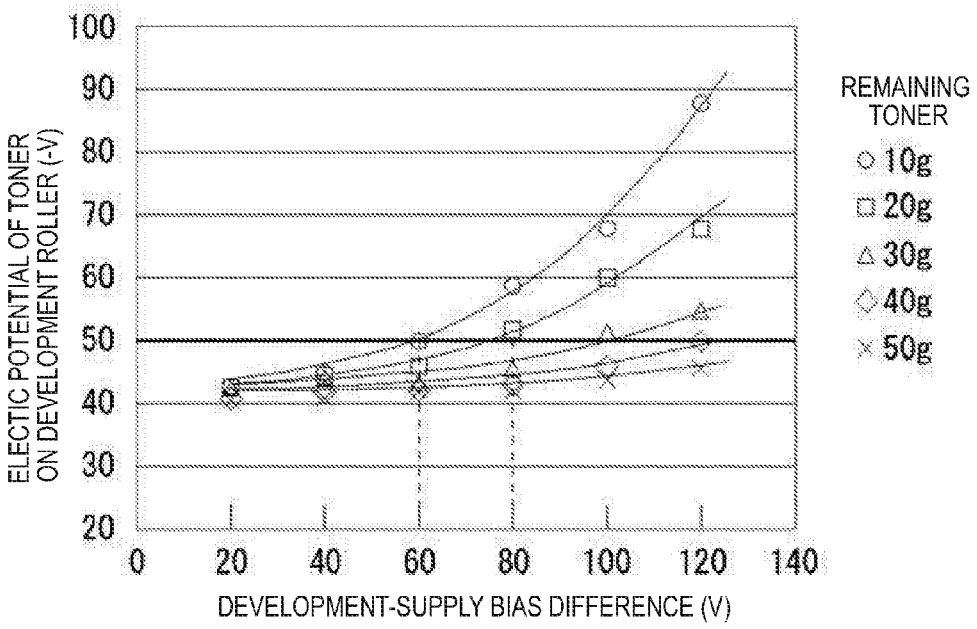
FIG. 4 is a diagram illustrating the relationship between the development-supply bias difference and the amount of charge of toner.

Herein, the attention is focused on the relationship between the difference between development bias VDB and supply bias VSB and the electric potential of the toner on development roller 23 in image formation apparatus 1. Hereinafter, the difference between development bias VDB and supply bias VSB is referred to as a development-supply bias difference. The relationship between the development-supply bias difference and the electric potential of toner is measured by the variation of the remaining amount of toner (amount of toner remaining in toner storing unit 29 of image formation cartridge 8). The measurement results are illustrated in FIG. 4.

In image formation apparatus 1, both of development and supply biases VDB and VSB are negative voltages as described above. In the following description, the phrase like "the bias is large" means that the absolute value of the bias is large, and the phrase like "the bias is small" means that the absolute value of the bias is small. The remaining amount of toner is set to one of the five values of 10, 20, 30, 40, and 50 g (grams) as the comparatively small value.

In image formation cartridge 8 of image formation apparatus 1, the toner is charged negatively. In order to move the negatively-charged toner from the surface of supply roller 24 to the surface of development roller 23, supply bias VSB (−300 V, for example) is set larger than development bias VDB (−200 V). The development-supply bias difference is therefore 100 V in this case.

In image formation cartridge 8, the larger the development-supply bias difference, the more likely charges are to be injected into the toner, and the higher the amount (or the absolute value) of the charge of the toner adhering to the surface of development roller 23. With reference to FIG. 4, when the remaining amount of toner is any one of the values from 10 to 50 g, there is a tendency for the larger development-supply bias differences to result in larger absolute values of the electric potential of the toner.

In image formation cartridge 8, there is a tendency for the amount of the charge of the toner adhering to development roller 23 to increase as the remaining amount of toner decreases. With reference to FIG. 4 again, at a certain development-supply bias difference (100V, for example), the absolute value of the electric potential of the toner increases as the remaining amount of toner decreases.

In image formation apparatus 1, therefore, the development-supply bias difference is corrected so as to be reduced when the remaining amount of toner becomes comparatively small. This can reduce the amount of charge of toner adhering to development roller 23, thus preventing the contamination.

In image formation apparatus 1, in order to obtain −50 V as the electric potential of the toner adhering to development roller 23, development-supply bias difference is set to 80 V when the remaining amount of toner is 20 g. When the toner is used and the remaining amount of toner decreases to 10 g, development-supply bias difference is set to 60 V (FIG. 4). Image formation apparatus 1 reduces the development-supply bias difference gradually as the toner is used and the remaining amount of toner decreases, so that the contamination is continuously prevented.

In image formation apparatus 1, it is confirmed by experiments and the like that the contamination occurs when the electric potential of the toner on development roller 23 is not lower than −60 V. Accordingly, in image formation apparatus 1, it is preferable to set the development-supply bias difference so that the electric potential of the toner becomes lower than −60 V.

[3-3. Relationship Between the Continuous Printing Time and the Amount of Charge of Toner]

Next, the relationship between the printing time and the electric potential of the toner on development roller 23 during a low-duty continuous printing by image formation apparatus 1 is measured by the variation of the printing amount. The measurement results are illustrated in FIG. 5.

The image ratio at the low-duty continuous printing is set to 1%. The printing amount is set to one of four values of 10, 50, 100, and 200 prints over 30 minutes. The remaining amount of toner at the start of printing is set to 50 g.

Figure 5:
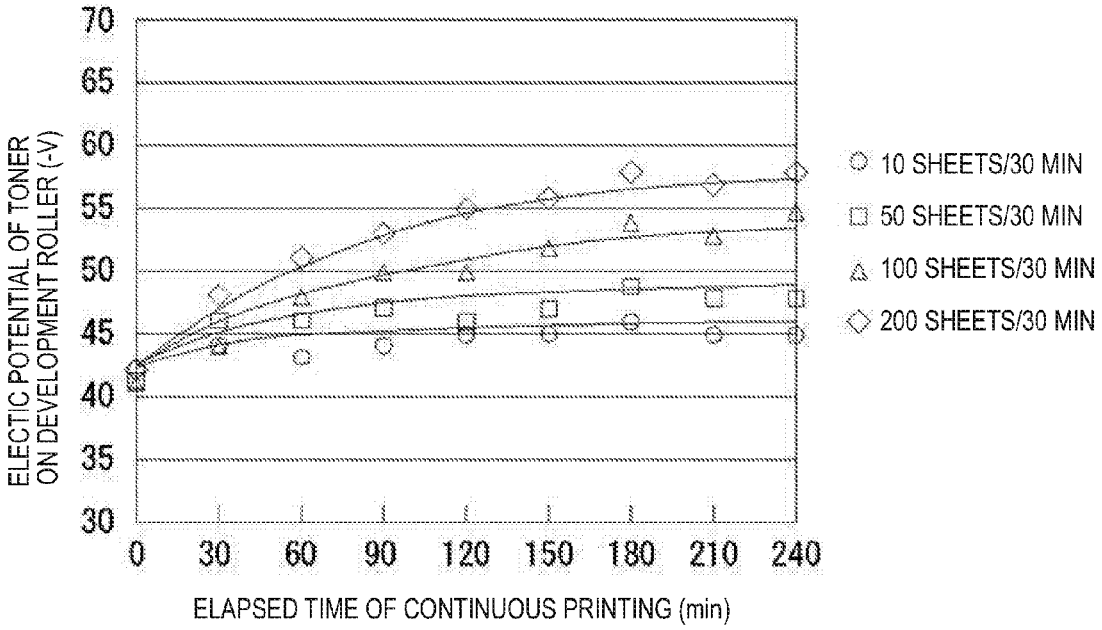
FIG. 5 is a diagram illustrating the relationship between a continuous printing elapsed time and the amount of charge of toner.

FIG. 5 shows a tendency for the amount of charge of toner on development roller 23 to increase as the printing amount (the number of prints), in other words, the amount of operation of image formation cartridge 8 (the number of rotations of photoreceptor drum 21) per unit time, increases. FIG. 5 also shows a tendency for the amount of charge of toner on development roller 23 to increase as the continuous printing time increases.

At a low-duty continuous printing performed by image formation apparatus 1, the contamination tends to occur when the continuous printing amount per unit time is large, the continuous printing time is long, and the remaining amount of toner is comparatively small. In image formation apparatus 1, the contamination can be suppressed by reducing the development-supply bias difference to prevent an increase in the amount of charge of toner on development roller 23.

In image formation apparatus 1, at a continuous printing with a comparatively high image ratio, that is, at a so-called high-duty continuous printing, the toner is used by printing before the amount of charge of the toner on development roller 23 becomes excessively high. Accordingly, the contamination does not occur.

In image formation apparatus 1, as for the specific conditions, it is necessary to select a proper combination of conditions based on the measurement result illustrated in FIG. 5 so that the amount of charge of toner on development roller 23 becomes such an electric potential that can cause the contamination (−60 V, for example). The conditions include, for example, the remaining amount of toner that can cause the contamination, the image ratio considered to be a low duty, the number of prints and the time of continuous printing. The specific conditions depend on the model of the image formation apparatus. Hereinafter, such an electric potential that can cause the contamination is also referred to as an extra developer adhesion electric potential.

[3-4. Relationship Between the Development Bias and Density]

Next, the relationship between the development bias VDB applied to development roller 23 and the density of toner in an image formed on paper P (hereinafter, referred to as a print density) in image formation apparatus 1 is measured for different values of the remaining amount of toner. The measurement result is illustrated in FIG. 6.

The print density herein is an optical density (OD) value measured by a spectrodensitometer. The remaining amount of toner (the amount of toner remaining in toner storing unit 29 of image formation cartridge 8) is set to one of the three values of 10, 20, and 30 g as the comparatively small amount. For each measurement, a low-duty printing (with an image ratio of 1%) is performed for about 100 sheets of paper for about 60 minutes after the image formation apparatus 1 is powered up (not immediately after the image formation apparatus 1 is powered up) so that the charged state of the toner is stabilized.

Figure 6:
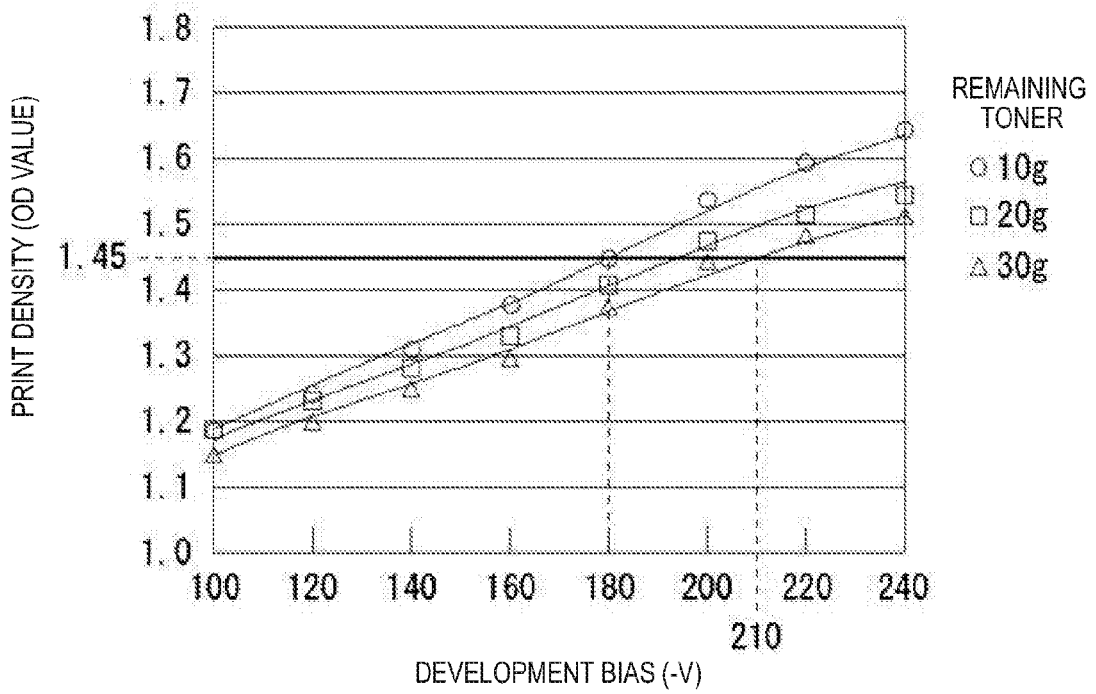
FIG. 6 is a diagram illustrating the relationship between the development bias and print density.

FIG. 6 illustrates a tendency for larger values of development bias VDB to result in higher values of the print density. When development bias VDB is large, the difference in electric potential between development bias VDB and the exposed part on the surface of photoreceptor drum 21 becomes large, and this increases the toner moving from the surface of development roller 23 to the surface of photoreceptor drum 21.

FIG. 6 also illustrates the tendency for smaller values of the remaining amount of toner to result in higher values of the print density. This is because, when continuous printing is performed with a small amount of toner remaining, the performance of supply roller 24 in scraping the toner is degraded as described above, and the amount of toner adhering to the surface of development roller 23 is increased.

In image formation apparatus 1, when the remaining amount of toner is comparatively small, the value of development bias VSB is set small. The amount of toner adhering to the surface of development roller 23 can, therefore, be reduced, thus preventing the increase in print density.

In order to adjust the print density to 1.45 in FIG. 6, image formation apparatus 1 sets the value of development bias VSB to −210 V when the remaining amount of toner is 30 g, for example. When the toner is used and the remaining amount of toner is reduced to 10 g, image formation apparatus 1 sets the development bias to −180 V. In such a manner, image formation apparatus 1 gradually reduces the value of development bias VDB as the toner is used and the remaining amount of toner decreases, thus preventing the increase in print density.

[3-5. Correction of the Applied Voltages]

In image formation apparatus 1, when the remaining amount of toner is comparatively small, the development-supply bias difference and the value of development bias VDB are corrected so as to be reduced with a decrease in the remaining amount of toner, so that the contamination and an increase in print density can be prevented. Moreover, it is revealed in image formation apparatus 1 that, as the toner is used and the remaining amount of toner is reduced, the maximum remaining amount of toner that causes the print density to increase is smaller than the maximum remaining amount of toner that causes the contamination to occur.

Figure 7:
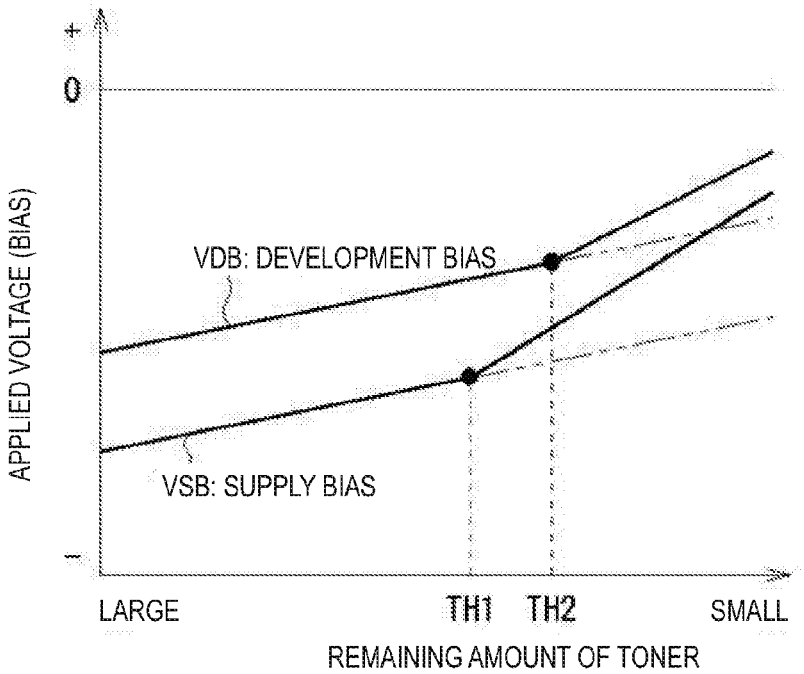
FIG. 7 is a diagram illustrating the relationship between the remaining amount of toner and the applied voltage.

Image formation apparatus 1 is therefore configured to set and correct the values of development bias VDB and supply bias VSB in accordance with the remaining amount of toner as illustrated in FIG. 7.

When the remaining amount of toner is large enough, image formation apparatus 1 sets the proper print density by reducing the values of development bias VDB and supply bias VSB (close to zero) little by little as the amount of toner decreases. In this case, image formation apparatus 1 sets substantially equal to each other, the decreases in the values of development bias VDB and supply bias VSB with respect to the decrease in the remaining amount of toner, that is, the slope of each characteristic curve in FIG. 7. Image formation apparatus 1 thereby keeps the development-supply bias difference substantially constant when the remaining amount of toner is comparatively large.

On the other hand, when the remaining amount of toner is reduced to less than a predetermined first threshold TH1 (80 g, for example), image formation apparatus 1 increases the magnitude of the decrease in supply bias VSB in response to the decrease in the remaining amount of toner. This means that the slope of the characteristic curve (with respect to the horizontal axis) is greater in a region where the remaining amount of toner is smaller than the first threshold TH1 than it is in the region where the remaining amount of toner is not smaller than first threshold TH1.

When the remaining amount of toner is reduced to less than the first threshold TH1, image formation apparatus 1 gradually reduces the development-supply bias difference as the amount of toner decreases. Image formation apparatus 1 can therefore prevent the electric potential of the toner on development roller 23 from increasing and can keep the electric potential of the toner substantially constant (FIG. 4). Accordingly, paper P is prevented from being contaminated.

When the remaining amount of toner is reduced to less than a second threshold TH2 (40 g, for example), which is smaller than first threshold TH1, image formation apparatus 1 increases the magnitude of the decrease in the value of development bias VDB in response to the decrease in the remaining amount of toner. This means that the slope of the characteristic curve (with respect to the horizontal axis) is set to be greater in a region where the remaining amount of toner is smaller than second threshold TH2 than it is in the region where the remaining amount of toner is not smaller than second threshold TH2.

In other words, when the remaining amount of toner is reduced to less than second threshold TH2, image formation apparatus 1 gradually reduces the value of development bias VDB as the amount of toner decreases. Image formation apparatus 1 can therefore keep the amount of toner adhering to the surface of development roller 23 substantially constant without increasing the same (FIG. 6). Accordingly, the print density is prevented from increasing.

In FIG. 7, in the region where the remaining amount of toner is smaller than second threshold TH2, the slope of development bias VDB is smaller than the slope of supply bias VSB and is close to the horizontal. Accordingly, image formation apparatus 1 can gradually reduce the development-supply bias difference with the decrease in the remaining amount of toner when the remaining amount of toner is smaller than second threshold TH2 as well as when the remaining amount of toner is in a range between the first and second thresholds TH1 and TH2.

As described above, image formation apparatus 1 can suppress the contamination and an increase in print density by correcting the values of supply and development biases VSB and VDB in accordance with the remaining amount of toner to form the characteristic curve illustrated in FIG. 7.

Moreover, image formation apparatus 1 also reduces the development-supply bias difference at a low-duty continuous printing with a comparatively small amount of toner remaining. This can prevent an increase in the amount of charge of toner on development roller 23 and can therefore suppress the contamination.

4. Image Formation Processing Procedure

Figure 8:
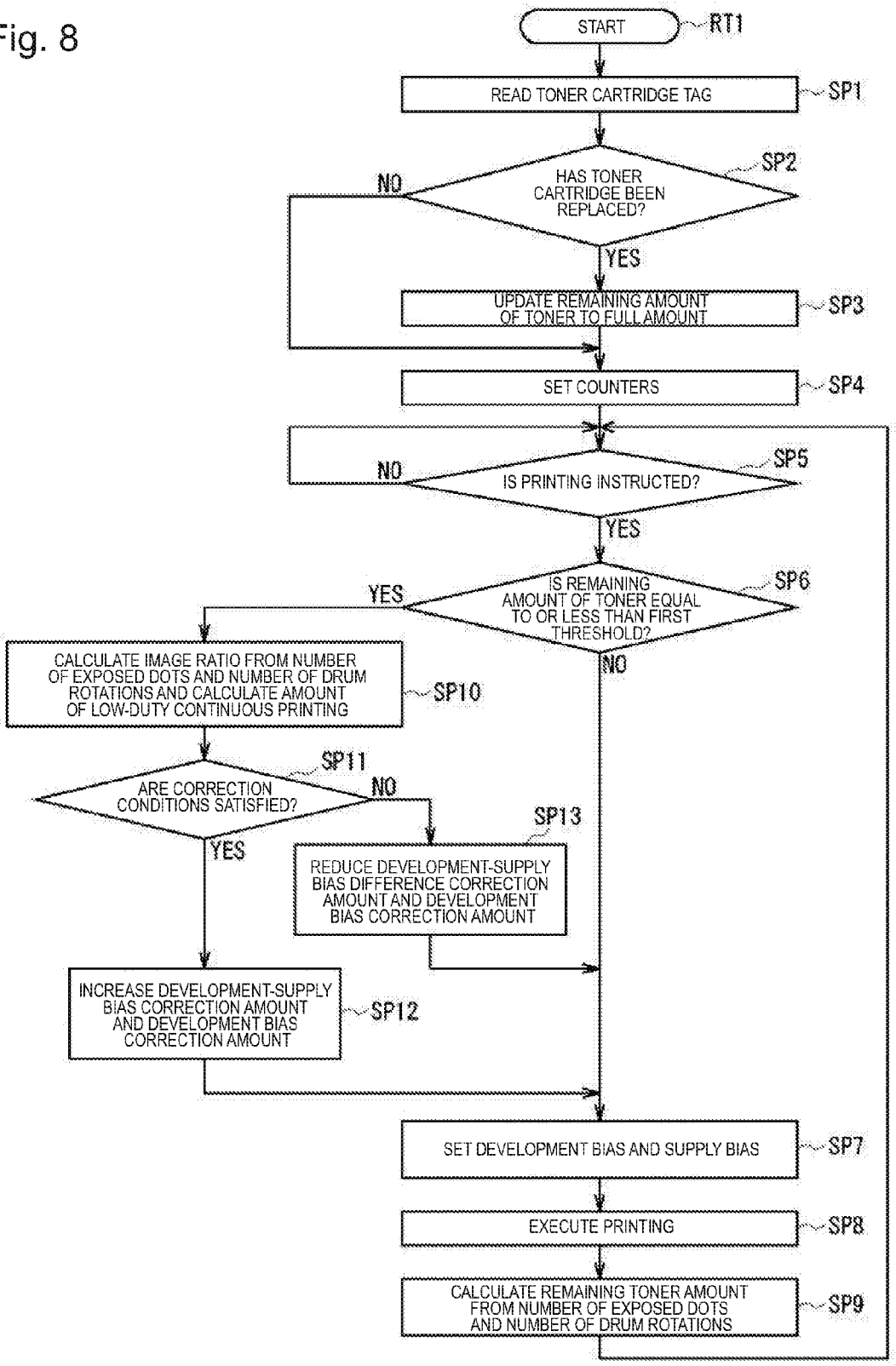
FIG. 8 is a flowchart illustrating an image formation processing procedure.

Actually, image formation apparatus 1 executes the image formation processing procedure RT1 illustrated in FIG. 8 at the image forming operation to form an image on paper P based on image data D supplied from the master device. Image formation apparatus 1 stores the toner cartridge tag previously read, the previous remaining amount of toner, and the like in a flash memory of storage unit 42 or the like in advance.

Specifically, when image formation apparatus 1 is powered up, controller 3 of image formation apparatus 1 starts image formation processing procedure RT1 (FIG. 8) and moves to step SP1. In step SP1, controller 3 starts to measure the elapsed time after image formation apparatus 1 is powered up by using timer 51. Controller 3 then reads the toner cartridge tag attached to toner cartridge 30 with the tag reader and reads the previously-read data of the toner cartridge tag (previous tag data) from storage unit 42. Controller 3 then moves to step SP2.

In step SP2, controller 3 compares the tag data newly read with the previous tag data read from storage unit 42 to determine whether toner cartridge 30 is new. The positive result thereof indicates that toner cartridge 30 has been replaced while image formation apparatus 1 is powered down and it is necessary to initialize the remaining amount of toner stored in storage unit 42.

Controller 3 then moves to the next step, SP3, and updates the stored remaining amount of toner to the amount of toner with which toner cartridge 30 is filled completely (the full amount). Controller 3 then stores the data of the new toner cartridge tag (current tag data) and moves to the next step, SP4. Moreover, controller 3 initializes the development-supply bias difference correction amount used to correct the development-supply bias difference and the development bias correction amount used to correct the value of development bias VDB to 0.

On the other hand, the negative result in step SP2 indicates that the current toner cartridge tag is the same as that used in the previous printing operation and the toner cartridge 30 has not been replaced. Accordingly, the stored remaining amount of toner can be used as it is. Controller 3 moves to the next step, SP4, without changing the remaining amount of toner and the tag data stored in storage unit 42.

Controller 3 initializes exposed dot counter 52 and drum rotation counter 53 (FIG. 3) to 0 in step SP4 and moves to the next step, SP5. In step SP5, controller 3 determines whether controller 3 has received an instruction from the master device to print image data D. When the result is negative, controller 3 repeats step SP5 to wait for an instruction to print image data D from the master device. On the other hand, when the result is positive, controller 3 moves to the next step, SP6.

In step SP6, controller 3 determines whether the remaining amount of toner is smaller than first threshold TH1 (FIG. 7). The negative result indicates that the remaining amount of toner is comparatively large. It is therefore unnecessary to change the development-supply bias difference correction amount and development bias correction amount. Controller 3 then moves to the next step, SP 7.

In step SP7, controller 3 applies the development-supply bias difference correction amount and development bias correction amount respectively to the development-supply bias difference and the value of development bias VDB, which are set in advance based on the remaining amount of toner, to calculate corrected values of the development-supply bias difference and the value of development bias VDB. Next, controller 3 subtracts the corrected value of the development-supply bias difference from the corrected value of the development bias VDB to calculate the corrected value of supply bias VSB. Controller 3 then sets corrected values of development bias VDB and supply bias VSB to development roller voltage supply 33 and supply roller voltage supply 34, respectively, and then moves to step SP8.

In step SP8, controller 3 executes the series of printing operations to form an image based on image data D on paper P and moves to the next step, SP9. When the remaining amount of toner is larger than first threshold TH1 at this time, controller 3 sets the development-supply bias difference to a certain comparatively large value (100 V, for example) and sets development bias VDB to a comparatively large value. Controller 3 can thereby form a high-quality image on paper P without contaminating paper P and excessively increasing the print density.

In step SP9, controller 3 causes remaining developer calculator 55 to calculate the toner consumption at printing based on the number of exposed dots counted by exposed dot counter 52 (FIG. 3) and the number of rotations of photoreceptor drum 21 counted by drum rotation counter 53. Controller 3 then subtracts the calculated toner consumption from the previous remaining amount of toner stored in storage unit 42 to calculate the current remaining amount of toner. Controller 3 stores the current remaining amount of toner for an update and returns to step SP5 again.

Herein, the toner consumption is calculated as an amount of toner discharged from toner storing unit 29 of image formation cartridge 8 to the outside during the printing operation, that is, the amount of toner moved from development roller 23 to the surface of photoreceptor drum 21. Due to the structure of image formation cartridge 8, toner is slightly used for dots of an image at which toner does not need to be transferred to paper P in addition to the dots at which toner needs to be transferred to paper P (hereinafter, such toner is also referred to as fogging toner).

The toner consumption is therefore calculated as the sum of the amount of toner used for printed dot part, which is dots (pixels) on photoreceptor drum 21 irradiated with light from exposure head 27, and the amount of toner used for the unprinted dot part which are dots on photoreceptor drum 21 not irradiated by exposure head 27 (that is, the total amount of fogging toner).

Specifically, the amount of toner consumed at the printed dot part is calculated as a product of the amount of toner necessary for image formation per exposed dot and the number of dots exposed at the printing. The amount of toner used at the unprinted dot part is calculated as a product of the amount of fogging toner per dot and the number of dots in the unprinted dot part.

The amount of toner necessary for image formation per exposed dot and the amount of fogging toner per dot can be obtained by experiments or the like. The number of dots in the unprinted dot part can be calculated by subtracting the number of dots actually exposed at the printing from the number of dots of the entire region of printed paper P available for image formation. The entire region of printed paper P available for image formation can be calculated by multiplying the width of photoreceptor drum 21 (the length in the cross direction) by the number of rotations of photoreceptor drum 21 (the number of rotations of the drum counted by drum rotation counter 53) and converting the same into the number of dots.

On the other hand, the positive result in step SP6 indicates that the remaining amount of toner is comparatively small and there is the possibility of the contamination and increase in print density. Controller 3 then moves to the next step, S10, and calculates the average of image ratio per unit time (hereinafter, referred to as an average image ratio) and the amount of low-duty continuous printing per unit time and moves to the next step, SP11.

Controller 3 calculates the average image ratio per unit time based on the number of exposed dots obtained by exposed dot counter 52 and the number of drum rotations obtained by drum rotation counter 53 in a printing process performed for the past 30 minutes, for example. Specifically, controller 3 calculates the ratio of the number of exposed dots required for printing to the number of dots corresponding to the area of the entire printable region at the printing performed for the past 30 minutes, in terms of area percentage (%). The area of the entire printable region is calculated in a similar manner to step SP9.

Controller 3 calculates the low-duty continuous printing amount per unit time as the number of rotations of photoreceptor drum 21 rotated for the formation of the low-duty image for the past 30 minutes, for example. In this case, controller 3 uses drum rotation calculating unit 54 to calculate the number of rotations of photoreceptor drum 21 during the low-duty continuous printing for the past 30 minutes and, based on the calculated number of rotations, determines the magnitude of the amount of charge of toner adhering to the surface of development roller 23. Controller 3 may count the number of sheets of paper P subjected to the low-duty printing instead of the number of rotations of photoreceptor drum 21.

In step SP11, based on the average image ratio per unit time and low-duty continuous printing amount per unit time which are calculated in step SP10, controller 3 determines whether the correction conditions are satisfied. The correction conditions herein are "the average image ratio for the past 30 minutes is not higher than 10% and the number of drum rotations is not less than 400", for example.

The positive result indicates that there is the possibility of the contamination and increase in print density. In this case, controller 3 moves to the next step, SP12, and increases the development-supply bias difference correction amount and development bias correction amount. Controller 3 then moves to step SP7.

Controller 3 recalculates each correction amount every predetermined recalculation time period (30 minutes, for example) after the measurement starts in step SP1. Controller 3 increases the correction amounts to larger values when the correction conditions continue to be satisfied and reduces the correction amounts to smaller values when the correction conditions are not satisfied. Each correction amount is weighted in accordance with the remaining amount of toner. The smaller the remaining amount of toner, the larger the correction amount is. For example, controller 3 sets the correction amounts so that the development-supply bias difference is reduced and the value of development bias VDB (the absolute value thereof) is reduced as the duration of low-duty continuous printing increases or the remaining amount of toner is reduced.

Specifically, controller 3 calculates the development-supply bias correction amount using development-supply bias difference correction basic amount table TA and correction coefficient table TB illustrated in FIGS. 9A and 9B. Development-supply bias difference correction basic amount table TA includes correction basic amount RA determined in accordance with a combination of the average image ratio (the average of the image ratio over 30 minutes) and the remaining amount of toner in a table format. Correction coefficient table TB includes correction coefficient RB in accordance with the number of rotations over 30 minutes in a table format.

Controller 3 reads correction basic amount RA in accordance with the average image ratio and the remaining amount of toner from development-supply bias difference correction basic amount table TA, and reads correction coefficient RB in accordance with the number of rotations over 30 minutes from the correction coefficient table TB. Subsequently, controller 3 multiplies correction basic amount RA by correction coefficient RB to calculate the correction amount (V) of the development-supply bias difference. Controller 3 calculates the correction amount of the development-supply bias difference every 30 minutes and accumulates the calculated correction amounts. Controller 3 limits the maximum value of the correction amount to 100 V.

Controller 3 calculates the development bias correction amount using development bias correction basic amount table TC and correction coefficient table TD illustrated in FIGS. 10A and 10B. Development bias correction basic amount table TC includes correction basic amount RC determined in accordance with a combination of the average image ratio and the remaining amount of toner in a table format in a similar manner to development-supply bias difference correction basic amount table TA. In development bias correction basic amount table TC, the value of correction basic amount RC is set to 0 in accordance with second threshold TH2 set to 40 g in a range of the remaining amount of toner between 80 and 40 g. Correction coefficient table TD includes correction coefficient RD in association with the number of rotations over 30 minutes in a table format in a similar manner to correction coefficient table TB.

Controller 3 reads correction basic amount RC in accordance with the average image ratio and the remaining amount of toner from development bias correction basic amount table TC and reads correction coefficient RD in accordance with the number of rotations over 30 minutes from the correction coefficient table TD. Subsequently, controller 3 multiplies correction basic amount RC by correction coefficient RD to calculate the correction amount (V) of development bias VDB. Controller 3 calculates the correction amount of development bias VDB every 30 minutes and accumulates the calculated correction amounts. Controller 3 limits the maximum value of the correction amount to 50 V.

On the other hand, the negative result in step SP11 indicates that the possibilities of the contamination and increase in print density are lowered and the correction amounts of the development-supply bias difference and development bias VDB need to be reduced. Controller 3 then moves to the next step, SP13.

In step SP13, controller 3 multiplies correction basic amount RA, read from development-supply bias difference correction basic amount table TA (FIG. 9A), by correction coefficient RB, read from correction coefficient table TB, to calculate the correction amount (V) of the development-supply bias difference in a similar manner to step SP12. Controller 3 then subtracts the calculated correction amount from the previous development-supply bias difference correction amount to reduce the cumulative value of the development bias correction amount.

Controller 3 multiplies correction basic amount RC read from development bias correction basic amount table TC (FIG. 10A) by correction coefficient RD read from correction coefficient table TD to calculate the correction amount (V) of the development bias in a similar manner to step SP12. Controller 3 then subtracts the calculated correction amount from the previous development bias correction amount to reduce the cumulative value of the development bias correction amount.

Controller 3 then executes the processes in steps SP7, SP8, and SP9. In step SP7, controller 3 sets the values of supply bias VSB and development bias VDB using the development-supply bias difference correction amount and development bias correction amount newly calculated in steps SP12 or SP13. Controller 3 therefore forms a high-quality image on paper P without contaminating paper P and without excessively increasing the print density.

Controller 3 repeats the process to form an image on paper P, that is, the printing process by executing image formation processing procedure RT1, and toner is used accordingly. When it is detected by the toner end sensor (not illustrated) provided for toner storing unit 29 of image formation cartridge 8 that the remaining amount of toner is extremely small, that is, that toner cartridge 30 is empty, controller 3 notifies the user by displaying a predetermined message on a not-illustrated display unit or by another way.

When the user replaces toner cartridge 30, controller 3 performs the processes of steps SP1 to SP3 to update the remaining amount of toner to the full amount at executing image formation processing procedure RT1 again. Controller 3 therefore sets the values of supply bias VSB and development bias VDB in accordance with the comparatively-large remaining amount of toner in the subsequent step, SP7.

5. Operation and Effects

In the aforementioned configuration, controller 3 of image formation apparatus 1 corrects the values of supply bias VSB and development bias VDB when the amount of toner remaining in toner storing unit 29 of image formation cartridge 8 becomes comparatively small so that the development-supply bias difference is smaller than that when the remaining amount of toner is comparatively large (FIG. 7). Image formation apparatus 1 can prevent an increase in the electric potential of toner adhering to the surface of development roller 23 (FIG. 4) within image formation cartridge 8 (FIG. 2). It is therefore possible to suppress the contamination on paper P on which an image is formed.

Moreover, when the amount of toner remaining in toner storing unit 29 of image formation cartridge 8 is comparatively small and low-duty continuous printing is performed for a long time, controller 3 of image formation apparatus 1 corrects the values of supply bias VSB and development bias VDB so that the development-supply bias difference is smaller than that when the remaining amount of toner is comparatively large (FIG. 7). Image formation apparatus 1 can therefore prevent an increase in the electric potential of toner adhering to the surface of development roller 23 (FIG. 5). It is therefore possible to suppress contamination on paper P on which an image is formed.

Furthermore, when the amount of toner remaining in toner storing unit 29 of image formation cartridge 8 is comparatively small, controller 3 of image formation apparatus 1 corrects the value of development bias VDB so that the development bias VDB is smaller than that when the remaining amount of toner is comparatively large (FIG. 7). Image formation apparatus 1 can therefore prevent an increase in the amount of toner adhering to the surface of development roller 23 (FIG. 6), thus preventing an excessive increase in the print density on paper P where the image is formed.

By correcting the values of supply bias VSB and development bias VDB in accordance with the amount of toner remaining in toner storing unit 29 of image formation cartridge 8 and the duration of low-duty continuous printing as described above, controller 3 of image formation apparatus 1 can properly suppress the contamination and suppress an increase in print density.

Still furthermore, when the remaining amount of toner is reduced to less than first threshold TH, controller 3 makes the development-supply bias difference smaller than that when the remaining amount of toner is comparatively large. Controller 3 moreover gradually reduces the development-supply bias difference with a decrease in the remaining amount of toner (FIG. 7) while a decrease in the remaining amount of toner conventionally results in an increase in the electric potential of the toner (FIG. 4). Image formation apparatus 1 can therefore keep substantially constant, the electric potential of the toner on development roller 23 by gradually reducing the development-supply bias difference, and thereby continuing to prevent the contamination.

In a similar manner, when the remaining amount of toner is comparatively small, controller 3 makes the value of development bias VDB smaller than that when the remaining amount of toner is comparatively large, and further gradually reduces the value of development bias VSB with a decrease in the remaining amount of toner (FIG. 7). Image formation apparatus 1 can therefore keep substantially constant, the amount of toner adhering to the surface of development roller 23 by gradually reducing the value of development bias VDB while a decrease in the remaining amount of toner conventionally results in an increase in the amount of toner (FIG. 6). Accordingly, image formation apparatus 1 can continue to prevent any increase in print density.

Still furthermore, in addition to first threshold TH1, controller 3 sets second threshold TH2 which is smaller than first threshold TH1. Controller 3 reduces supply bias VSB to reduce only the development-supply bias difference when the remaining amount of toner is reduced to less than first threshold TH1. When the remaining amount of toner is further reduced to less than second threshold TH2, controller 3 reduces the value of development bias VDB (FIG. 7). Accordingly, when the remaining amount of toner is reduced to less than first threshold TH1, image formation apparatus 1 reduces only the value of supply bias VSB to deal with only the contamination. This can prevent the print density from unnecessarily lowering and prevent an occurrence of faded prints and the like.

Still furthermore, controller 3 calculates the development-supply bias difference correction amount by using development-supply bias difference correction basic amount table TA and correction coefficient table TB (FIG. 9B). Controller 3 can therefore calculate the development-supply bias difference correction amount only through comparatively simple arithmetic processing, such as multiplying correction basic amount RA read from table TA by correction coefficient RB read from table TB and accumulating the same. Accordingly, the processing load can be extremely smaller than that of a method performing a complicated arithmetic processing using functions or the like. The same applies to the development bias correction amount.

Still furthermore, image formation apparatus 1 calculates the amount of toner which adheres to photoreceptor drum 21 and is consumed (the toner consumption) within image formation cartridge 8 during image formation and subtracts the calculated toner consumption from the previous remaining amount of toner. Accordingly, the amount of toner remaining in toner storing unit 29 of image formation cartridge 8 can be accurately calculated. This can eliminate the need for image formation apparatus 1 to include an expensive sensor or the like capable of accurately detecting the amount of toner remaining in toner storing unit 29, thus preventing the configuration from being complicated and preventing an increase in cost.

According to the above-described configuration, image formation apparatus 1 reduces the development-supply bias difference when the remaining amount of toner becomes comparatively small and when low-duty continuous printing continues for a long period of time, and reduces the value of development bias VDB when the remaining amount of toner is comparatively small. In image formation apparatus 1, it is therefore possible to prevent increases in the electric potential and amount of toner adhering to the surface of development roller 23. Accordingly, image formation apparatus 1 suppresses both the contamination on paper P where the image is formed and the excessive increase in print density.

6. Other Embodiments

In the aforementioned embodiment, the remaining amount of toner is calculated by calculating the amount of toner which adheres to photoreceptor drum 21 and is consumed (toner consumption) in image formation cartridge 8 during image formation, and subtracting the calculated toner consumption from the previous remaining amount of toner. However, the invention is not limited thereto. For example, a sensor which detects the remaining amount of toner may be provided within toner storing unit 29 or toner cartridge 30 of image formation cartridge 8. The remaining amount of toner is recognized based on the detection result obtained from the sensor. In this case, the sensor can be properly selected from sensors which detect the remaining amount of toner by various known methods, including optical sensors, magnetic sensors, electric potential sensors, and the mechanical sensor described in Patent Literature 1, for example.

In the aforementioned embodiment, two different thresholds, that is, first and second thresholds TH1 and TH2, are determined so that the remaining amount of toner at which the development-supply bias difference starts to be reduced is different from the remaining amount of toner at which development bias VDB starts to be reduced. However, the invention is not limited thereto. In the case where it is revealed by measurement that the maximum remaining amount of toner that causes the contamination is substantially equal to the maximum remaining amount of toner that causes the print density to increase, for example, image formation apparatus 1 may start to reduce both of the development-supply bias difference and the value of development bias VDB when the remaining amount of toner is reduced to less than the common threshold.

In the aforementioned embodiment, when the remaining amount of toner is comparatively small, image formation apparatus 1 reduces both of the development-supply bias difference and the value of development bias VDB. However, the invention is not limited thereto. When the remaining amount of toner is comparatively small, image formation apparatus 1 may reduce any one of the development-supply bias difference and the value of supply bias VSB.

In the aforementioned embodiment, when the remaining amount of toner is less than first threshold TH1, image formation apparatus 1 reduces the development-supply bias difference gradually with a decrease in the remaining amount of toner (FIG. 7). However, the invention is not limited thereto. When the remaining amount of toner is less than first threshold TH1, for example, the development-supply bias difference may be set to a comparatively small constant value irrespective of the decrease in the remaining amount of toner. The same applies to the value of development bias VDB.

In the aforementioned embodiment, in step SP11 of image formation processing procedure RT1 (FIG. 8), the correction conditions include both the average image ratio per unit time and amount of low-duty continuous printing. However, the invention is not limited thereto. For example, the correction conditions may include only the average image ratio per unit time.

In the aforementioned embodiment, the development-supply bias correction amount is calculated using correction base amount RA read from development-supply bias difference correction basic amount table TA (FIG. 9A) and the like. However, the invention is not limited thereto. The development-supply bias correction amount may be calculated through various methods. For example, the development-supply bias correction amount is calculated by preparing a function using the amount of toner, average image ratio, and the like as the variables and performing arithmetic processing using the prepared function. Compared with the method including the steps of referring to the tables, the method using the function can eliminate the need for a storage capacity for storing the tables although increasing the amount of arithmetic processing. The same applies to the development bias correction amount.

In the aforementioned embodiment, the development-supply bias difference and the value of development bias VDB are reduced in the case of forming an image with toner that tends to be charged negatively. However, the invention is not limited thereto. The development-supply bias difference and the value of development bias VDB may be reduced in the case of forming an image with toner that tends to be charged positively. In this case, development bias VDB, supply bias VSB, and the like have positive values, and the negative and positive polarities of the characteristic curves in FIG. 7 need to be reversed, that is, need to be turned upside down.

In the aforementioned embodiment, the invention is applied to image formation apparatus 1 which is an electrophotographic printer. However, the invention is not limited thereto. The invention may be applied to various electronic devices including the function of printing by fixing a developer such as toner onto paper to form an image, such as a multi-function printer and a copier, for example.

The invention is not limited to the embodiment and other embodiments described above. The invention is applicable to embodiments including proper combinations of apart or all of the aforementioned embodiments and aforementioned other embodiments or properly extracted part(s) of the embodiments.

Moreover, in the aforementioned embodiment, image formation apparatus 1 as the image formation apparatus includes photoreceptor drum 21 as the image carrier, exposure head 27 as the exposure unit, toner storing unit 29 as a container part, supply roller 24 as the supply unit, development roller 23 as the development unit, developer remaining amount calculator 55 as the remaining amount detector, development roller voltage supply 33 as the development voltage application unit, supply roller voltage supply 34 as the supply voltage application unit, and voltage controller 44 as the voltage controller. However, the invention is not limited thereto. The image carrier, exposure unit, container part, supply unit, development unit, remaining amount detector, development voltage application unit, supply voltage application unit, and voltage controller constituting the image formation apparatus may be configured in various manners.

The invention is applicable to various electronic devices that use toner to form an image and fix the image onto paper for printing, such as printers and facsimiles.

The invention includes other embodiments in addition to the above-described embodiments without departing from the spirit of the invention. The embodiments are to be considered in all respects as illustrative, and not restrictive. The scope of the invention is indicated by the appended claims rather than by the foregoing description. Hence, all configurations including the meaning and range within equivalent arrangements of the claims are intended to be embraced in the invention.

What is claimed is:

1. An image formation apparatus, comprising:

an image carrier;

an exposure unit which exposes the image carrier to form a latent image;

a container part which stores a developer;

a supply unit which supplies the developer within the container part;

a development unit which supplies the developer supplied from the supply unit to the latent image on the image carrier for development;

a remaining amount detector which detects a remaining amount of the developer in the container part;

a development voltage application unit which applies a development voltage to the development unit;

a supply voltage application unit which applies a supply voltage to the supply unit; and a voltage controller which controls the development voltage and the supply voltage, wherein when the remaining amount of the developer detected by the remaining amount detector is reduced to a predetermined first threshold or less, the voltage controller makes an absolute value of a difference between the development voltage and the supply voltage smaller than that used when the remaining amount of the developer is larger than the first threshold.

2. The image formation apparatus according to claim 1, wherein the voltage controller reduces the absolute value of the difference between the development voltage and the supply voltage as the remaining amount of the developer decreases.

3. The image formation apparatus according to claim 1, wherein when the remaining amount of the developer detected by the remaining amount detector is reduced to a predetermined second threshold or less, the voltage controller makes an absolute value of the development voltage smaller than that used when the remaining amount of the developer is larger than the second threshold.

4. The image formation apparatus according to claim 3, wherein the voltage controller reduces the absolute value of the development voltage as the remaining amount of the developer decreases.

5. The image formation apparatus according to claim 1, wherein when the absolute value of an electric potential of the developer supplied to the development unit is larger than an extra developer adhesion electric potential, which is an electric potential that causes the developer to adhere to a part other than the latent image exposed by the exposure unit, the voltage controller makes the absolute value of the difference between the development voltage and the supply voltage smaller than that used when the absolute value of the electric potential of the developer is smaller than the extra developer adhesion electric potential.

6. The image formation apparatus according to claim 5, further comprising: a developer usage ratio calculator configured to calculate a developer usage ratio which is a ratio of an area where the developer is used to the entire area of media available for forming an image, wherein the voltage controller determines that the absolute value of the electric potential of the developer supplied to the development unit is larger than the extra developer adhesion electric potential when the image is formed on a predetermined number or more of pieces of a medium within a past predetermined time and an average of the developer usage ratio is less than a predetermined usage ratio threshold.

7. The image formation apparatus according to claim 1, wherein the exposure unit forms the latent image with a collection of pixels, and the remaining amount detector calculates a consumption of the developer based on an exposed pixel number, which is the number of pixels exposed by the exposure unit, and detects the remaining amount of the developer by calculation using the consumption.

8. The image formation apparatus according to claim 7, wherein the remaining amount detector calculates the remaining amount by using a sum of an amount of the developer used for a use region of the image and an amount of developer consumed for a non-use region, the use region being a region where the developer is used, and the non-use region being a region where the developer is not used.

* * * * *